US005730354A

United States Patent [19]

O'Connor

[11] Patent Number: 5,730,354

[45] Date of Patent: Mar. 24, 1998

[54] PRINTED TEAR TAPE

[75] Inventor: Lawrence J. O'Connor, Winnipeg, Canada

[73] Assignee: KT Industries Inc., Fort Wayne, Ind.

[21] Appl. No.: 679,205

[22] Filed: Jul. 12, 1996

[51] Int. Cl.[6] ..... B65D 85/10; B65D 17/00

[52] U.S. Cl. ..... 229/200; 206/264; 206/411; 493/923; 493/930; 229/240

[58] Field of Search ..... 206/264, 824, 206/411; 493/923, 930; 229/200, 203, 240

[56] References Cited

U.S. PATENT DOCUMENTS 3,809,227 5/1974 Begemann ..... 206/264
4,351,433 9/1982 Barber et al. ..... 206/264
4,836,378 6/1989 Lephardt .
4,844,962 7/1989 May et al. .
4,887,714 12/1989 O'Connor .
4,947,994 8/1990 Newsome ..... 206/264 X

*Primary Examiner*—Daniel Zirker
*Attorney, Agent, or Firm*—Adrian D. Battison; Murray E. Thrift

[57] ABSTRACT

A wrapped package carries a transparent overwrap material and a tear tape attached to the overwrap material for effecting tearing of the overwrap material. The tear tape has a layer of adhesive on one side of the tape substrate for adhesion to the overwrap material and a layer of ink arranged to provide visible markings for the tear tape. The ink is applied on the side of the adhesive which is remote from the tape so that when the tear tape is attached to the overwrap material by the adhesive, the second surface of the adhesive and the layer of ink thereon are in contact with the overwrap material and the markings are visible through the transparent overwrap material without viewing through the adhesive and without viewing through the tape.

6 Claims, 3 Drawing Sheets

PRINTED TEAR TAPE

This invention relates to a tear tape for tearing the overwrap of a package including printing on the tear tape together with a method of wrapping a package and a wrapped package both using the tear tape.

BACKGROUND OF THE INVENTION

Tear tapes carrying printing are disclosed in U.S. Pat. No. 4,887,714 of the present inventor (O'Connor) and in U.S. Pat. No 4,844,962 (May et al). A tear tape carrying a magnetic layer is disclosed in U.S. Pat. No. 4,836,378 (Lephardt). In each of these patents an adhesive layer is also applied to the tear tape for attachment of the tear tape to the overwrap material or to the package (as disclosed in Lephardt).

In O'Connor and May, the adhesive layer is applied to the tape prior to packaging of the tape for supply to the wrapping machine. It is necessary therefore that the tape carry on the side opposite to the adhesive layer a release coat to prevent bonding of the adhesive to the opposite side of the tape when wrapped into the package.

Both of these patents disclose the application of printing onto the tape itself either on the release coat side or on the same side as the adhesive layer underneath the adhesive layer and prior to application of the adhesive layer to the tape.

In addition O'Connor discloses the possibility that the adhesive layer itself is colored and laid onto the tape substrate in a pattern so as to provide indicia on the tape. This proposal has not received any commercial attention.

In other wrapping techniques, the tape is supplied without the adhesive and subsequently the adhesive is applied to the tape on the wrapping line prior to application of the tape into the wrapped package. In this case the adhesive is applied to the tape as the last material. This can be a pressure sensitive adhesive or can be a heat activated adhesive which remains in heated condition until it is attached into the package structure by cooling.

Thus generally the printed tear tape has adhesive applied to the tear tape after printing so that the printing lies underneath the adhesive layer.

The type of printing which can be used can be a simple longitudinal line which identifies the location of the tear tape so that it is more readily visible to the user when wishing to unwrap the package. In other cases the printing can include various indicia, for example a logo or product information.

Current processing of tear tape requires that the printing be applied to the substrate in web width prior to application of a covering layer over the printing of release coating or adhesive, depending upon to which side the printing is applied. Whichever side is used for the printing, it is necessary to heat the tape after the printing is completed to effect curing of the release coating or to effect drying of the water or solvent from the adhesive (if solvent or water based adhesive is used) or in application of a hot melt adhesive. When such heating occurs, the application of the heat shrinks the web so that its width is reduced. The length is not effected because the web remains under tension while being processed. As the width is reduced, the position of the web relative to slitting knives which slit the web into individual tape varies thus affecting the transverse alignment of the edges of the slit tape relative to the adhesive and the printing. A poorly misaligned tape is unattractive and unprofessional in appearance. Tear tapes have a high requirement for an effective release coat in view of the high winding tensions in the very long length packages which are presently required. If the printing is applied to the adhesive side of the tape after the application of the release coat then this requires careful handling of the web carrying the release coat to prevent transfer of the release coat to the adhesive side which would interfere with the application of the printing and the adhesive layer.

When the tear tape is applied to the package, the adhesive is used to bond the tear tape to the inside surface of the overwrap material. The overwrap material is transparent so that the tear tape is visible through the overwrap. When the printing is applied to the tear tape substrate on the adhesive side of the tape, the printing must be viewed through the overwrap material and through the adhesive layer. The adhesive layer significantly affects and degrades the appearance of the printed information as it interferes with the passage of light through the materials from the printed information to the eye, thus providing a poor appearance. In cases where the printing is applied on the release coated side, the printed information is also viewed through also the tear tape substrate. While these materials are generally transparent, particularly the adhesive interferes with the effective viewing of the printed material so that it is less visible to the user.

SUMMARY OF THE INVENTION

It is one object of the present invention, therefore, to provide an improved tear tape, wrapping method and wrapped package which avoids the above disadvantage.

According to a first aspect of the invention, therefore, there is provided a tear tape for attachment to an overwrap material for effecting tearing of the overwrap material comprising: a tape substrate having sufficient strength to effect tearing of the overwrap material when pulled; a layer of adhesive on one side of the tape substrate for adhesion to the overwrap material, the layer of adhesive having a first side attached to the tape substrate and a second side remote from the tape substrate; and a layer of ink on the second side of the adhesive arranged to provide visible markings for the tear tape.

According to a second aspect of the invention, therefore, there is provided a method for wrapping and unwrapping a package comprising: providing a package to be wrapped; providing a transparent overwrap material for engagement around the package; forming a tear tape for attachment to the overwrap material for effecting tearing of the overwrap material by: providing a tape substrate having sufficient strength to effect tearing of the overwrap material when pulled; applying a layer of adhesive on one side of the tape substrate for adhesion to the overwrap material, the layer of adhesive having a first side attached to the tape substrate and a second side remote from the tape substrate; and applying a layer of ink on the second side of the adhesive arranged to provide visible markings for the tear tape; attaching the tear tape to the overwrap material using the adhesive such that the second surface of the adhesive and the layer of ink are in contact with and adhesively attached to the overwrap material and such that the layer of ink is visible through the transparent overwrap material; wrapping the overwrap material with the tear tape attached thereto around the package; and pulling the tear tape to effect tearing of the overwrap material.

According to a third aspect of the invention, therefore, there is provided a wrapped package comprising: a package; a transparent overwrap material engaged around the package; and a tear tape attached to the overwrap material for effecting tearing of the overwrap material, the tear tape comprising: a tape substrate having sufficient strength to effect tearing of the overwrap material when pulled; a layer of adhesive on one side of the tape substrate for adhesion to the overwrap material, the layer of adhesive having a first side attached to the tape substrate and a second side remote from the tape substrate; and a layer of ink on the second side of the adhesive arranged to provide visible markings for the tear tape; the tear tape being adhesively attached to the overwrap material by the adhesive and the layer of ink being in contact with and visible through the transparent overwrap material.

BRIEF DESCRIPTION OF THE DRAWINGS

Embodiments of the invention will now be described in conjunction with the accompanying drawings, in which.

In the drawings like characters of reference indicate corresponding parts in the different figures.

DETAILED DESCRIPTION

Figure 1:
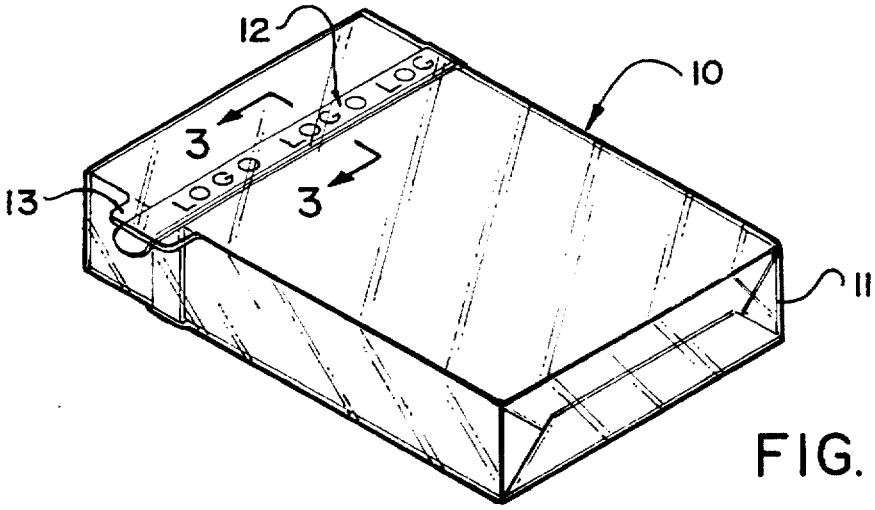
FIG. 1 is a schematic isometric view of a wrapped package according to the present invention.

A conventional wrap package is shown in FIG. 1 which includes an underlying often rectangular package 10 covered by an overwrap material 11 which is generally transparent plastics material folded and sealed around the rectangular package to form a closed cover around the package. To effect tearing of the overwrap material to assist the user in unwrapping the package, there is provided a tear tape 12 which is bonded to an inside surface of the overwrap material and wrapped around the package leaving a tab 13 at the exposed end of the tear tape at which the overwrap material and a tear tape can be pulled. The tear tape has sufficient strength to effect tearing of the overwrap material as it is pulled so the overwrap material can be split and readily removed from the package.

Figure 3:
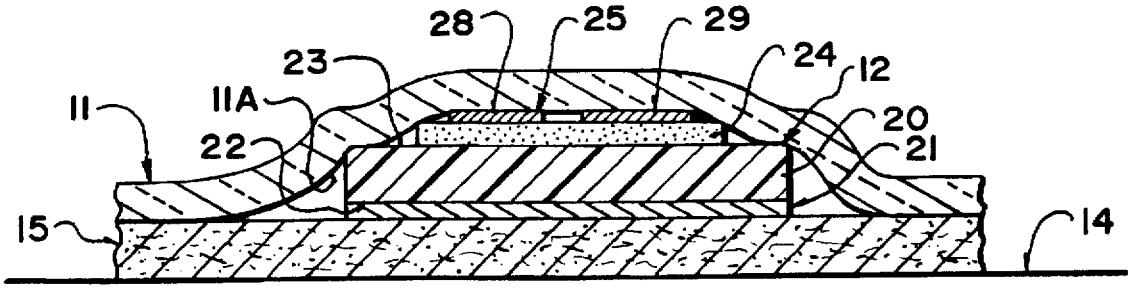
FIG. 3 is a cross sectional view of the tear tape of FIG. 2, the cross section being taken along the lines 3—3 of FIG. 1.

The structure of the package is shown in more detail in FIG. 3 including an underlying package structure 14 and a covering layer 15 which is generally of folded card to form the conventional container for example, the rectangular box in which cigarettes are stored. The overwrap material 11 engages around the layer 15 and is free from attachment thereto so that it can be readily removed when torn without damaging the outside surface of the layer 15.

The tear tape 12 comprises a tape substrate 20 having on a lower side a layer 21 of a release coat material, generally silicone based.

Thus the tape substrate is relatively thin and has a bottom surface 22 on which the layer 21 is applied. The tape substrate also includes an upper surface 23 carrying a layer of adhesive 24. On top of the adhesive layer is applied a layer of printed ink indicated at 25 so that the ink is spaced away from the surface 23 and is carried on a top surface or exposed surface of the adhesive itself.

The adhesive is applied, in the example shown, so that it has a width narrower than a width of the tape substrate leaving two side portions 26 and 27 of the tape substrate on the side 23 which are exposed and free from adhesive. Adhesive of the full width of the substrate can be used.

The printed ink layer 25 can include a single longitudinal continuous line 28 and can include a series of indicia 29 for example defining a logo or other printed information such as product information and health warning information. The printing may include one or other elements 28 and 29 or can include both.

As shown in the package structure of FIG. 3, the tear tape is attached to the overwrap material by intimate engagement between the layer 24 and the inside surface 11A of the overwrap material 11. Also the ink material 25 including the line 28 and the indicia 29 is in intimate engagement with the inside surface 11A.

Figure 2:
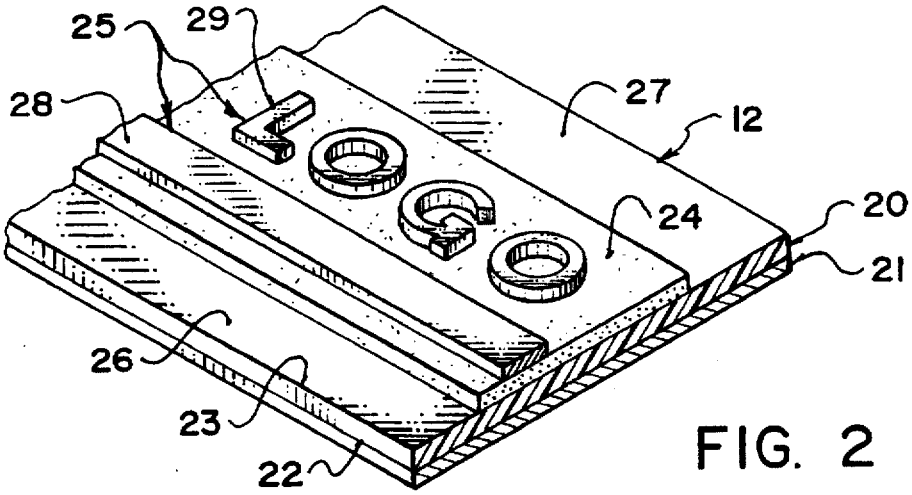
FIG. 2 is an isometric view of one portion of a tear tape according to the present invention.
Figure 4:
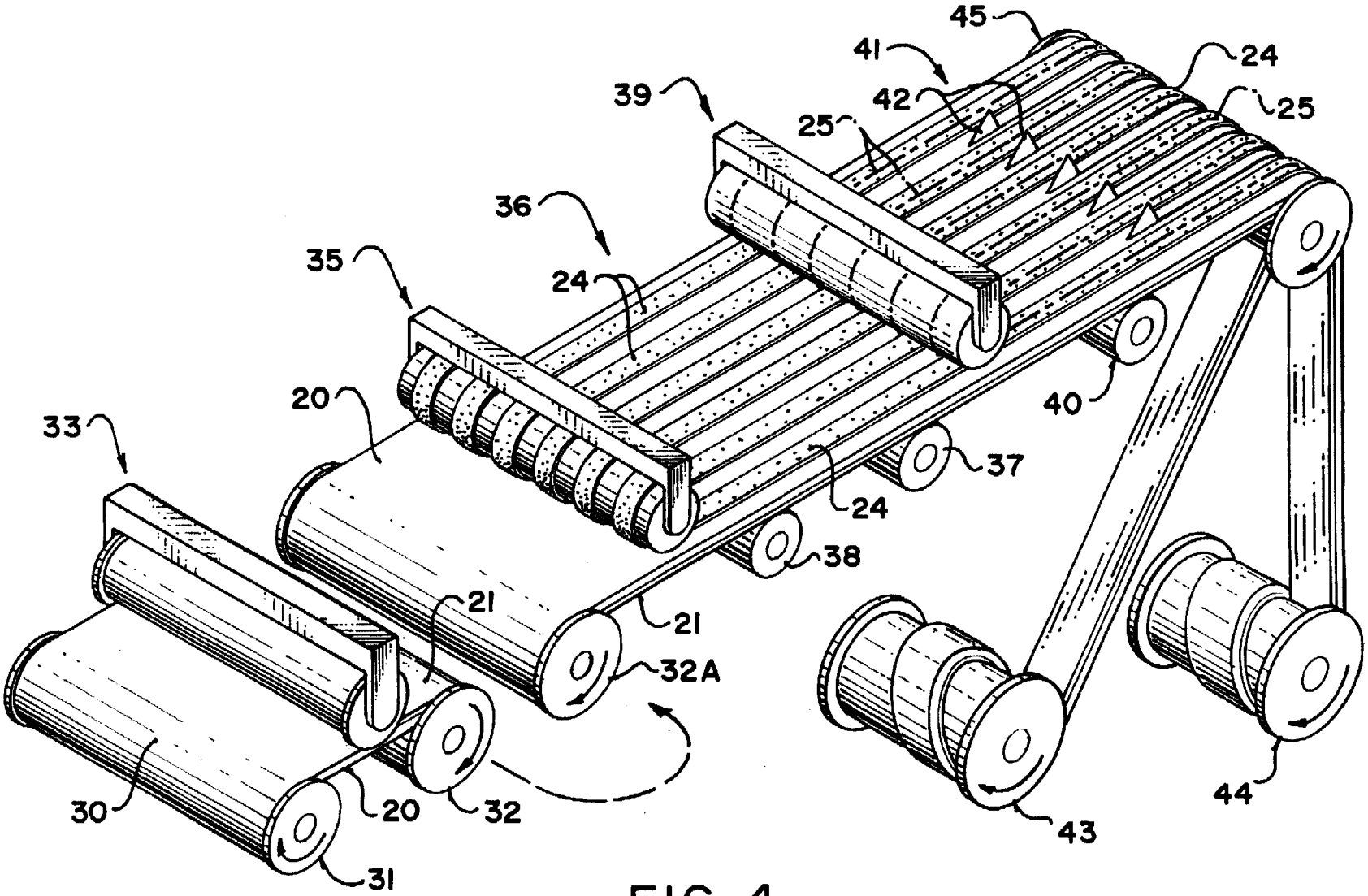
FIG. 4 is a schematic side elevational view of a method for manufacturing the tear tape of FIG. 3.
Figure 5:
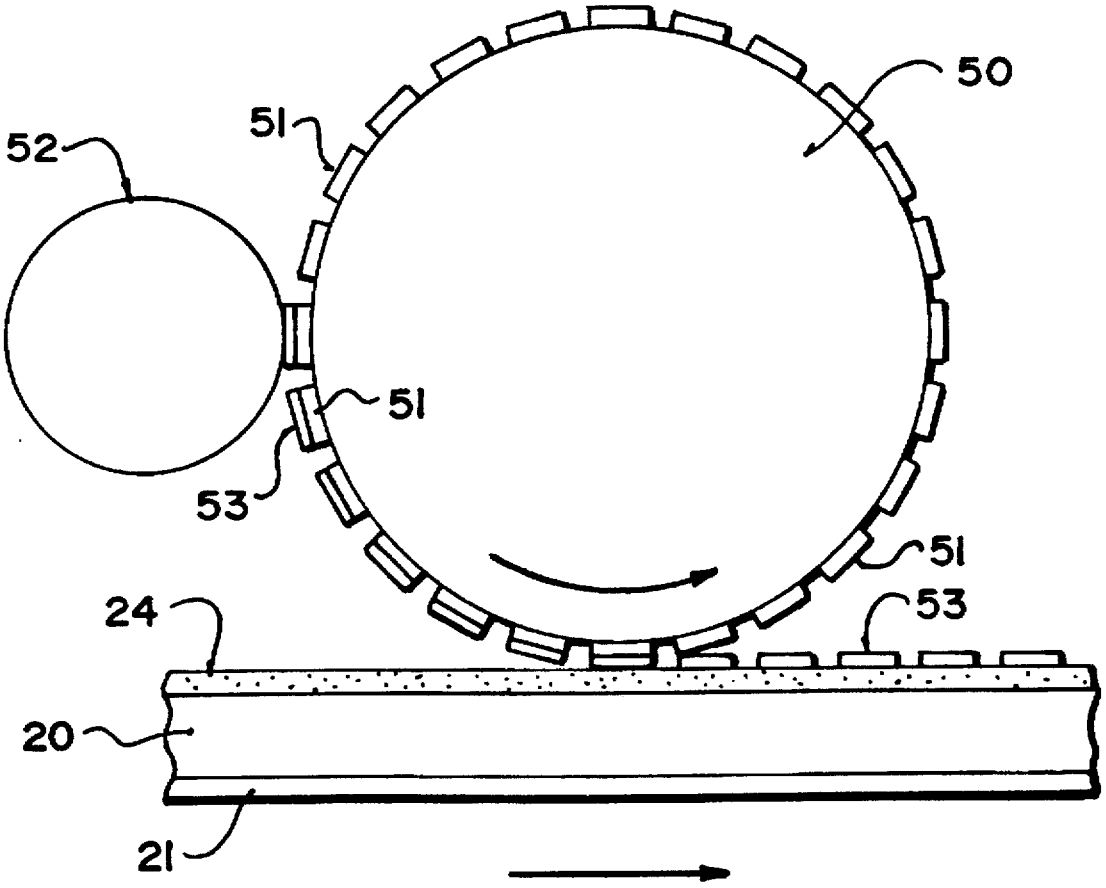
FIG. 5 is an enlarged side elevational view of one technique for effecting printing.
Figure 6:
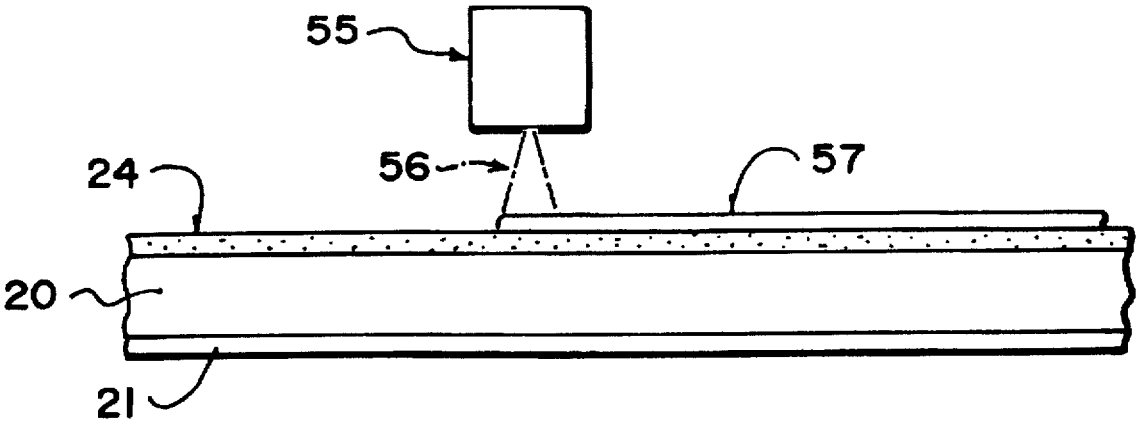
FIG. 6 is a similar schematic side elevational view of a second technique for effecting printing.

Turning now to FIGS. 4, 5 and 6 there is shown a method for manufacturing the tear tape illustrated in FIGS. 2 and 3.

Thus the method includes as a first step the supply of a web 30 of substrate material having a width sufficient to manufacture a plurality of the tear tapes slit from the width of the web. The web is supplied on a roll 31 and is drawn from that roll and rewound onto a second roll 32 after passage through a station 33 in which the release coat 21 is applied. The details of this portion of the method are not shown since they are well known to one skilled in the art.

The roll 32 is then taken and supplied to a second station in which the roll forms the feed roll 32A of the system. The substrate material carrying the layer 21 is therefore unwound from the roll 32A and passed through a first station 35 in which the adhesive layer 24 is applied to the web. As the web is intended to be slit into a plurality of separate tapes, a plurality of strips of the adhesive are applied at transversely spaced positions across the width of the web. The adhesive is applied by a conventional technique including a gravure roller using conventional adhesive materials which can be solvent based or can be hot melt adhesives.

After application of the adhesive strips 24, the web carrying the adhesive strips is passed through a cooling zone 36, in which the adhesive strips are allowed to set with the heat therefrom extracted, or are heated for extraction of the solvent or water if the solvent base system is used.

After passing through the cooling zone 36, the web carrying the set adhesive material passes over a guide roller 37 so that any shrinkage or distortion of the web due to the heating and cooling is effected between the guide roller 37 and a previous guide roller 38 so that the guide roller 37 the web is stable. The web is then passed through a further station 39 at which printing of the layer 25 is applied onto the adhesive strips 24.

Downstream of the station 39 the web passes over a further guide roller 40 to a slitting station 41 including a plurality of slitting knifes 42 which act to slit the web into a plurality of individual tear tapes of the type shown in FIGS. 2 and 3. The individual tear tape are then wound on packages 43 and 44 after passage over a guide roller 45.

Further details of the stations 39 are shown as alternatives in FIGS. 5 and 6. In FIG. 5 the station 39 includes a printing roller 50 having raised printing elements 51 which are supplied with ink from a supply roller 52 so that only the raised elements 51 carry the ink layer as indicated at 53. The raised elements are sufficiently high so that only the raised elements engage the adhesive layer 24 so that the ink is applied to the adhesive layer without any other elements of the roller 50 coming into contact with the adhesive layer so that no adhesive is picked off the adhesive layer.

The printed pattern of the indicia is arranged so as to leave some of the adhesive which is not fully covered by the ink giving enough bonding effect to the overwrap to achieve the required attachment. The pattern can however be relatively complex to give an attractive or "designer" appearance. The ink is normally applied only to the adhesive without reaching onto the adjacent portions of the substrate which are free from the adhesive. The adhesive can extend to the edges of the substrate. The substrate can be colored to provide an attractive effect in combination with the matching or contrasting coloring of the ink.

In FIG. 6 is shown an alternative arrangement in which there is no contact between the adhesive layer 24 and a jet printing system schematically indicated at ,55. The jet printing system thus generates a jet stream 56 of the ink which forms a layer 57 in the required pattern to lay down the indicia and information required.

The application of the ink to the exposed upper surface of the adhesive ensures that the ink is intimately in contact with the inside surface of the overwrap material so that it is directly visible through the overlap material without the interference of other underlying layers.

The application of the ink to the upper surface of the adhesive subsequent to the application of the adhesive to the tape substrate ensures that the ink is applied subsequent to any distortion or shrinkage of the tape substrate and immediately prior to slitting so that the application of the ink can be accurately aligned with the slitting knives to ensure that it is properly placed relative to the side edges of the tape.

In this regard it will be appreciated that the figures illustrated herein are distorted as to scale since the tear tape generally has a width less than 0.25 inches and in many cases of the order of 0.125 inches. In such a case, the printing may have a width of the order of 0.1 inches so that it will be appreciated that it is necessary to ensure accurate alignment so that it is properly and evenly positioned on the tear tape.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. In a wrapped package comprising:

a package;

a transparent overwrap material engaged around the package;

and a tear tape attached to the overwrap material for effecting tearing of the overwrap material, the tear tape comprising:

a tape substrate having sufficient strength to effect tearing of the overwrap material when pulled;

a layer of adhesive on one side of the tape substrate for adhesion to the overwrap material, the layer of adhesive having a first side attached to the tape substrate and a second side remote from the tape substrate;

and a layer of ink arranged to provide visible markings for the tear tape;

the tear tape being adhesively attached to the overwrap material by the adhesive;

the improvement in which:

the ink to provide visible markings for the tape lies on said second side of the adhesive which is remote from the tape;

the tear tape is attached to the overwrap material by the adhesive such that the second surface of the adhesive and the layer of ink thereon are in contact with the overwrap material and such that the layer of ink in contact with the overwrap material is visible through the transparent overwrap material without viewing through the adhesive and without viewing through the tape.

2. In a method for wrapping and unwrapping a package comprising:

providing a package to be wrapped;

providing a transparent overwrap material for engagement around the package;

forming a tear tape for attachment to the overwrap material for effecting tearing of the overwrap material by:

providing a tape substrate having sufficient strength to effect tearing of the overwrap material when pulled;

applying a layer of adhesive on one side of the tape substrate for adhesion to the overwrap material, the layer of adhesive having a first side attached to the tape substrate and a second side remote from the tape substrate;

and applying a layer of ink to provide visible markings for the tear tape;

attaching the tear tape to the overwrap material using the adhesive;

wrapping the overwrap material with the tear tape attached thereto around the package;

and pulling the tear tape to effect tearing of the overwrap material;

the improvement in which:

the ink to provide visible markings for the tape is applied, subsequent to the application of the adhesive to said one side of the tape, to said second side of the adhesive which is remote from the tape;

the tear tape is attached to the overwrap material using the adhesive such that the second surface of the adhesive and the layer of ink are in contact with the overwrap material and such that the layer of ink in contact with the overwrap material is visible through the transparent overwrap material without viewing through the adhesive and without viewing through the tape.

3. The method according to claim 2 wherein the layer of ink is applied to the second side of the adhesive using a roller having raised ribs defining the indicia to be applied and wherein the second side of the adhesive is contacted only by the raised ribs which carry ink onto the second side of the adhesive.

4. The method according to claim 2 wherein the layer of ink is applied to the second side of the adhesive using an ink jet such that the ink is applied to the second side of the adhesive without physical contact with the second side of the adhesive.

5. The method according to claim 2 wherein application of the adhesive to said one side of the substrate material involves causes heating of the substrate material and wherein the layer of ink is applied to the second side of the adhesive subsequent to cooling of the substrate material.

6. The method according to claim 5 wherein the substrate material is supplied in a web width and wherein, subsequent to the application of the ink to the second side of the adhesive, the substrate material is slit into a plurality of separate tapes.

* * * * *